US006191779B1

(12) United States Patent
Taguchi et al.

(10) Patent No.: US 6,191,779 B1
(45) Date of Patent: Feb. 20, 2001

(54) LIQUID CRYSTAL DISPLAY DEVICE, DEVICE FOR CONTROLLING DRIVE OF LIQUID CRYSTAL DISPLAY DEVICE AND D/A CONVERTING SEMICONDUCTOR DEVICE

(75) Inventors: Takashi Taguchi, Edogawa-ku; Tetsuro Itakura, Nerima-ku, both of (JP)

(73) Assignee: Kabushiki Kaisha Toshiba, Kawasaki (JP)

( * ) Notice: Under 35 U.S.C. 154(b), the term of this patent shall be extended for 0 days.

(21) Appl. No.: 09/114,195

(22) Filed: Jul. 13, 1998

(30) Foreign Application Priority Data

Jul. 11, 1997 (JP) ..... 9-186698

(51) Int. Cl.[7] ..... G09G 5/00

(52) U.S. Cl. ..... 345/204; 345/87; 345/98; 345/112; 345/210; 341/144

(58) Field of Search ..... 345/87, 98, 112, 345/204, 205, 208, 209, 210; 341/144

(56) References Cited

U.S. PATENT DOCUMENTS 4,662,358 * 5/1987 Farrar et al. ..... 600/16
4,950,999 * 8/1990 Agnello et al. ..... 324/76.22
5,510,748 * 4/1996 Erhart et al. ..... 327/530
5,604,510 * 2/1997 Blanchard ..... 345/98
5,668,550 * 9/1997 Coleman, Jr. ..... 341/119
5,731,774 * 3/1998 Fujii et al. ..... 341/144
5,751,261 * 5/1998 Zavracky et al. ..... 345/55
5,754,156 * 5/1998 Erhart et al. ..... 345/98
5,760,570 * 6/1998 Nagai et al. ..... 320/162
5,796,378 * 8/1998 Yoshida et al. ..... 345/88
5,956,006 * 9/1999 Sato ..... 345/88
6,040,815 * 3/2000 Erhart et al. ..... 345/98

FOREIGN PATENT DOCUMENTS 3-51887 3/1991 (JP) .
2-714161 10/1997 (JP) .

* cited by examiner

*Primary Examiner*—Bipin Shalwala
*Assistant Examiner*—Vincent E. Kovalick
(74) *Attorney, Agent, or Firm*—Oblon, Spivak, McClelland, Maier & Neustadt, P.C.

(57) ABSTRACT

A liquid crystal display device significantly reduces power consumption and causes no signal delay when a liquid crystal panel performs an inversion-type drive. The liquid crystal display device comprises a digital controller, a level shift circuit, a digital-to-analog (D/A) converter, a liquid crystal panel, and a plurality of capacitors. In the D/A converter, a charging control circuit is provided corresponding to each capacitor. The charging control circuit comprises a switch, a diode and an inverter, the switch and the diode being coupled in parallel. The switch is turned on and off in response to a switching signal from the digital controller. The switch is changed to a turning- on state during a blanking period after one horizontal displaying. Upon turning-on of the switch, the capacitors are charged. Digital pixel data outputted from the digital controller undergoes a level changing depending on a voltage across the electrodes of the capacitors, according to a charge conservation.

23 Claims, 7 Drawing Sheets

LIQUID CRYSTAL DISPLAY DEVICE, DEVICE FOR CONTROLLING DRIVE OF LIQUID CRYSTAL DISPLAY DEVICE AND D/A CONVERTING SEMICONDUCTOR DEVICE

BACKGROUND OF THE INVENTION

1. Field of the Invention

The present invention relates to an active-matrix type liquid crystal display device having a switching element for each pixel, and more particularly to a dot-inversion type liquid crystal display device which supplies voltages of different levels to the two switching elements corresponding to adjacent pixels.

2. Discussion of the Background

Thin Film Transistor (TFT) type liquid crystal display devices comprise a switching element and a pixel electrode (display electrode) for each of their pixels. Such devices are constituted in order that a transmittance of a liquid crystal layer changes depending on a voltage applied to the pixel electrode. One end of the switching element is supplied with a voltage in accordance with pixel data, and a voltage of the pixel electrode is controlled in accordance with the voltage applied to the switching element.

Unchanged application of a voltage in the same direction to the liquid crystal layer gives rise to fixing of an arrangement of the liquid crystal, resulting in a slow motion of the liquid crystal and blackish displaying. Therefore, in order to cope with such problem, a liquid crystal display device adopting an inversion driving type, which allows the voltage applied to the liquid crystal layer to make an inversion in one frame unit (one screen), in one horizontal line unit or in one pixel unit, has been proposed. As shown in FIG. 1 and described below, a positive side analog voltage is applied to a first pixel of the liquid crystal layer and a negative side analog voltage is applied to an adjacent pixel. Because separate voltages are generated, the associated circuit may introduce time delays between these signals. Also such a circuit may process pixel data having a large number of bits. Thus the circuit may have a large power consumption for processing such data.

For portable equipment driven with a battery, such as notebook type computers and electrical pocketbooks, lengths of driving time of the battery are essential factors which determine the added values of products, and products with a battery having a short life because of a large power consumption have a low commercial value, resulting in a lack of the competitive power in many cases.

SUMMARY OF THE INVENTION

From the foregoing, an object of the present invention is to provide a liquid crystal display device which consumes less power and causes no signal delay when a liquid crystal panel performs an inversion-type drive.

In order to achieve the foregoing object, the first aspect of a device for controlling a liquid crystal display device of the present invention comprises a digital control circuit which receives a first voltage and a second voltage higher than the first voltage as reference voltages and outputs a plurality of digital pixel data, a plurality of capacitors, a charging control circuit and a digital-to-analog (D/A) converter. Each capacitor has a first terminal coupled to the digital control circuit to receive a corresponding one of the plurality of digital pixel data. Each input terminal of the charging control circuit is coupled to a second terminal of a corresponding one of the capacitors. The D/A converter is coupled to each output terminal of the charging control circuit, and receives a fourth voltage and a fifth voltage higher than the fourth voltage as reference voltages, and outputs an analog voltage signal to a liquid crystal panel. After data is outputted from the charging control circuit, each second terminal of the capacitors is charged to a third voltage, charging is stopped in order to set each of the second terminals of the capacitors to a floating state, and the digital pixel data are outputted from the digital control circuit.

The second aspect of a semiconductor device for controlling a liquid crystal display device of the present invention comprises a digital control circuit which receives a first voltage and a second voltage higher than the first voltage as reference voltages and outputs first and second digital pixel data, a plurality of capacitor elements, a charging control circuit, first and second D/A converters, and a switch. Each capacitor has a first terminal coupled to receive the first digital pixel data. Each input terminal of the charging control circuit is coupled to a second terminal of a corresponding one of the capacitors. The first D/A converter is coupled to each output terminal of the charging control circuit, and receives a fourth voltage and a fifth voltage higher than the fourth voltage as reference voltages, and outputs a first analog voltage signal. The second D/A converter receives the second digital pixel data outputted from the digital control circuit and receives a sixth voltage signal and a seventh voltage higher than the sixth voltage, and outputs a second analog voltage signal. The first switch alternately switches in order to selectively apply either the first or second analog voltage signals to a liquid crystal panel at a predetermined timing. After data is outputted from the charging control circuit, each second terminal of the capacitors is charged to a third voltage, charging is stopped in order to set each second terminal of the capacitors to a floating state, and the first digital pixel data is outputted from the digital control circuit.

In one of the first and second aspects of the semiconductor device for controlling a liquid crystal display device of the present invention, the third aspect of the present invention has a feature in that after either the first digital pixel data or the second digital pixel data is outputted, either data obtained by adding the second voltage to the third voltage or data obtained by adding the first voltage to the third voltage is outputted from the charging control circuit via the capacitors.

In one of the first to third aspects of the semiconductor device for controlling a drive of a liquid crystal display device, the fourth aspect of the present invention has a feature in that the capacitors are charged during a blanking period from the completion of a displaying period of one horizontal line until the beginning of a displaying period of the next horizontal line.

In one of the first to fourth aspects of the semiconductor device for controlling a liquid crystal display device, the fifth aspect of the present invention has a feature in that the charging control circuit comprises a second switch having one terminal coupled to the capacitors and the other terminal coupled to the third voltage.

In one of the first to fifth aspects of the semiconductor device for controlling a liquid crystal display device, the sixth aspect of the present invention has a feature in that the charging control circuit comprises a diode having a cathode terminal coupled to the capacitors and an anode terminal set to the third voltage.

In the fifth aspect of the semiconductor device for controlling a liquid crystal display device, the seventh aspect of the present invention has a feature in that the second switch is turned on or off by a switching signal outputted from the digital control circuit.

In one of the first to seventh aspects of the semiconductor device for controlling a liquid crystal display device, the eighth aspect of the present invention has a feature in that a potential difference between the first and second voltages is set to be equal to the voltage difference between the fourth and fifth voltages.

In one of the first to eighth aspects of the semiconductor device for controlling a liquid crystal display device, the ninth aspect of the present invention has a feature in that a potential difference between the fourth and fifth voltages is set to be equal to the voltage difference between the sixth and seventh voltages.

In one of the first to ninth aspects of the semiconductor device for controlling a liquid crystal display device, the tenth aspect of the present invention has a feature in that the third voltage is equal to the fourth voltage.

In one of the first to tenth aspects of the semiconductor device for controlling a liquid crystal display device, the eleventh aspect of the present invention has a feature in that the second voltage is equal to the fourth voltage.

In one of the second to eleventh aspects of the semiconductor device for controlling a liquid crystal display device, the twelfth aspect of the present invention has a feature in that the charging control circuit and the first D/A converter are formed in the same chip.

The thirteenth aspect of a semiconductor device for controlling a liquid crystal display device of the present invention comprises a digital control circuit which receives a first voltage and a second voltage higher than the first voltage as reference voltages and outputs a plurality of digital pixel data, a plurality of capacitors, a charging control circuit, a D/A converter, and a liquid crystal panel. Each one terminal of a capacitor is coupled to a corresponding one of the digital pixel data. Each input terminal of the charging control circuit is coupled to another terminal of said corresponding one of the capacitors. The D/A converter is coupled to each output terminal of the charging control circuit, receives a fourth voltage and a fifth voltage higher than the fourth voltage as reference voltages, and outputs an analog voltage signal to the liquid crystal panel. The liquid crystal panel applies the analog voltage signal to each of a plurality of switching elements thereof. Each switching element is arranged in correspondence with each of a plurality of pixels of the liquid crystal panel. After data is outputted from the charging control circuit, each said another terminal of the capacitors is charged to a third voltage, charging is stopped in order to set each said another terminal of the capacitors to a floating state, and the digital pixel data is outputted from the digital control circuit.

The fourteenth aspect of a semiconductor device for controlling a liquid crystal display device of the present invention comprises a digital control circuit which receives a first voltage and a second voltage higher than the first voltage as reference voltages and outputs first and second digital pixel data, a plurality of capacitors, a charging control circuit, first and second D/A converters, a switch, and a liquid crystal panel. Each one terminal of each capacitor is coupled to receive the first digital pixel data. Each input terminal of the charging control circuit is coupled to another terminal of corresponding one of the capacitors; the first D/A converter is coupled to each output terminal of the charging control circuit, receives a fourth voltage and a fifth voltage higher than the fourth voltage as reference voltages, and outputs a first analog voltage signal. The second D/A converter receives a sixth voltage and a seventh voltage higher than the sixth voltage as reference voltages, thereby performing an analog conversion for the second digital pixel data, and outputs a second analog voltage signal. The switch switches between the first and second analog voltage signals at either every one pixel or every one horizontal line and selectively outputs either the first analog voltage signal or the second analog voltage signal. The liquid crystal panel applies either the first analog voltage signal or the second analog voltage signal to a plurality of switching elements thereof. Each switching element is arranged in correspondence with each of a plurality of pixels of the panel. After data is outputted from the charging control circuit, each said another terminal of the capacitor is charged to a third voltage, charging is stopped in order to set each said another terminal of the capacitor to a floating state, and the first digital pixel data is outputted from the digital control circuit.

In one of the thirteenth and fourteenth aspects of the liquid crystal display device, the fifteenth aspect of the present invention has a feature in that the switch is formed in the liquid crystal panel.

In one of the thirteenth and fifteenth of the liquid crystal display device, the sixteenth aspect of the present invention has a feature in that the switch is a polysilicon type TFT (thin film transistor).

According to the present invention, since the voltage level of the digital pixel data outputted from the digital pixel data is changed using the capacitor, a level shift circuit which has been heretofore used is unnecessary, so that a power consumption can be significantly reduced and a circuit constitution can be simplified. Moreover, no signal delay occurs, thus enhancing an image quality of the liquid crystal panel screen.

BRIEF DESCRIPTIONS OF THE DRAWINGS

For a more complete understanding of the present invention and the advantages thereof, reference is now made to the following description taken in conjunction with the accompanying drawings, in which.

DETAILED DESCRIPTION OF THE PREFERRED EMBODIMENTS

A liquid crystal display device of the present invention is described in detail below and with reference to the accompanying drawings.

Figure 1:
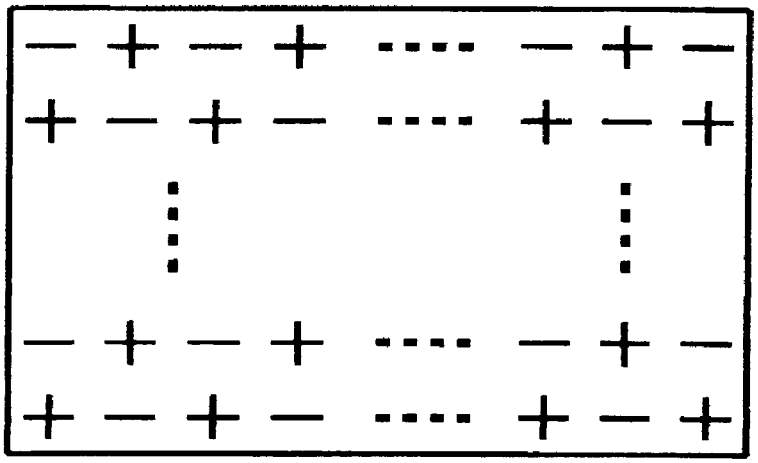
FIG. 1 is a schematic view illustrating a bit inversion type liquid crystal display device.
Figure 2:
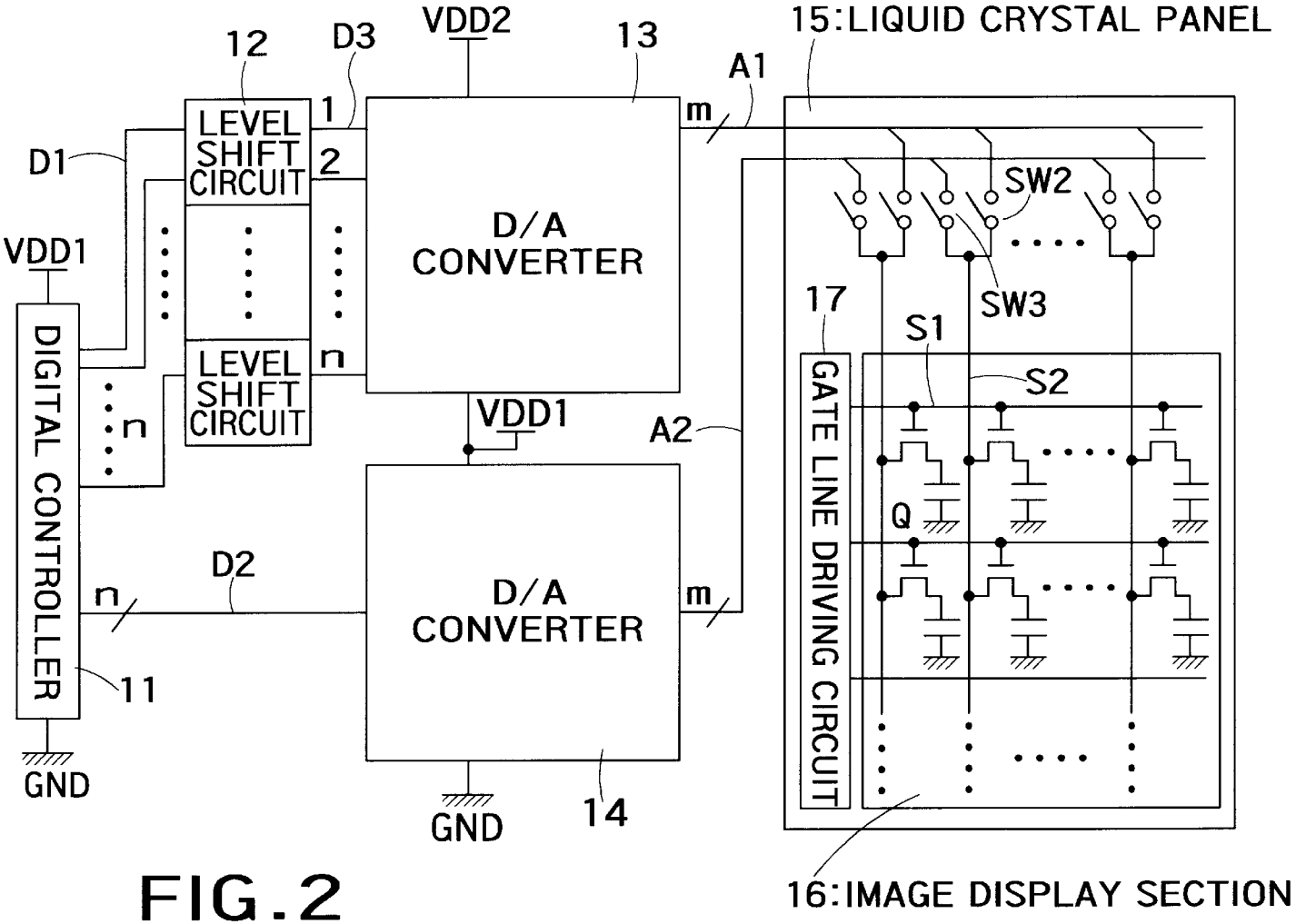
FIG. 2 is a block diagram showing an inversion driving type liquid crystal display device.
Figure 3:
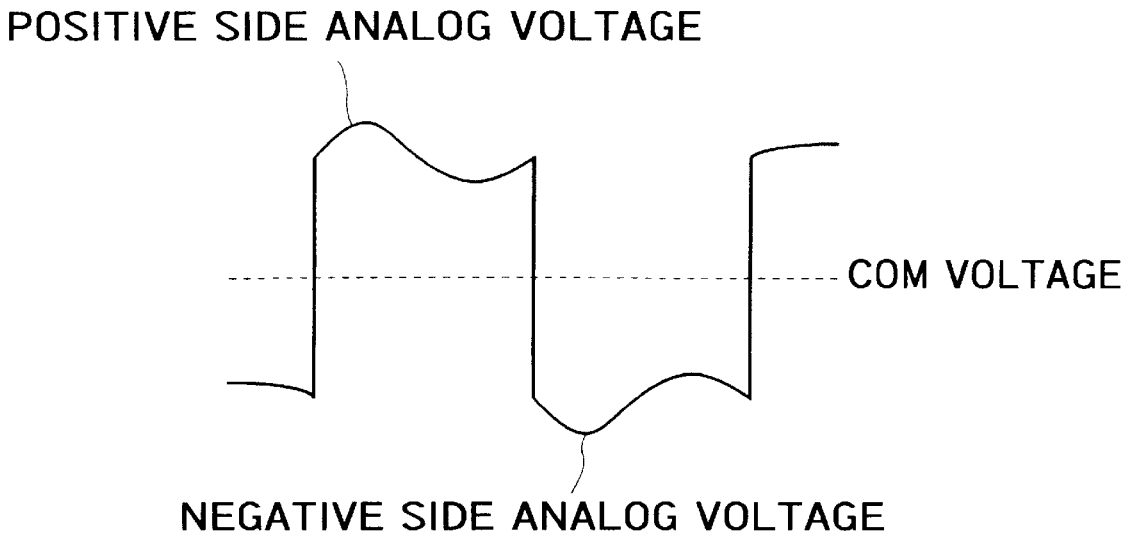
FIG. 3 is a graph illustrating wave shapes of a positive side analog voltage signal and a negative side analog voltage signal.

FIG. 2 is a block diagram showing an inversion driving type liquid crystal display device. FIG. 1 is a schematic view for illustrating a bit inversion type liquid crystal display device. FIG. 3 is a graph illustrating wave shapes of a positive side analog voltage and a negative side analog voltage. The liquid crystal display device illustrated in FIG. 2 adopts a dot inversion type which inverts the voltage applied to the liquid crystal layer in the one pixel unit. In the dot inversion type, the voltages applied to the liquid crystal layers of adjacent two pixels are inverted values, as shown in FIG. 1 schematically. A voltage (positive side analog voltage) higher than a COM voltage (common voltage) as shown in FIG. 3 is applied to the liquid crystal layer of the pixel illustrated in FIG. 1 using a symbol "+" A voltage (negative side analog voltage) obtained by inverting the positive side analog voltage symmetric with respect to the COM voltage is applied to the liquid crystal layer illustrated in FIG. 1 using a symbol "−".

The liquid crystal display device shown in FIG. 2 comprises a digital controller 11 for serially outputting digital pixel data D1 and D2 which are composed of n bits, respectively. A level shift circuit 12 converts a voltage level of the digital pixel data D1 outputted from the controller 11 to form digital pixel data D3. A digital-to-analog (D/A) converter 13 outputs a positive side analog voltage signal A1 in response to the digital pixel data D3. A D/A converter 14 outputs a negative side analog voltage signal A2 in response to the digital pixel data D2. A liquid crystal panel 15 includes thin film transistors (TFTs) that are arranged horizontally and vertically.

The digital controller 11 uses a power source voltage VDD1 and a ground voltage as a driving power source, which outputs digital pixel data of two kinds, one being the power source voltage VDD1 that is high in level and the other being the ground voltage that is low level. These digital pixel data are outputted from a plurality of signal lines in which a RGB signal line, a clock signal line, and a plurality of control signal lines (for example, horizontal and vertical synchronous signal lines) are included. For example, the number of signal lines is about in an embodiment when the D/A converters 13 and 14 are 6 bit D/A converters. The digital pixel data D2 is inputted to the D/A converter 14, and the other digital pixel data D1 is subjected to a level shift by the level shift circuit 12 and thereafter inputted to the D/A converter 13.

Figure 4:
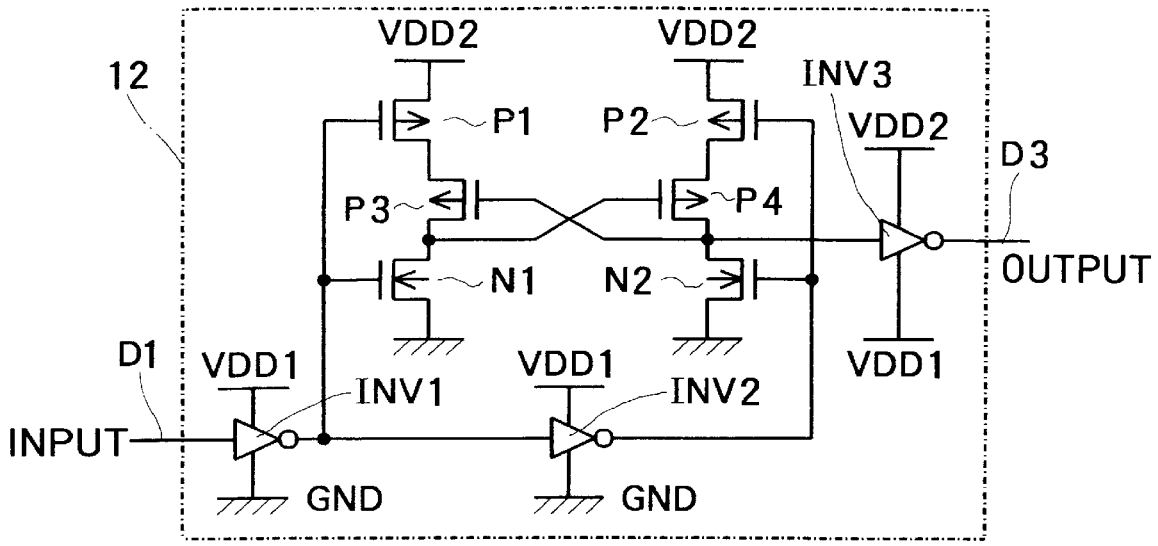
FIG. 4 is a circuit diagram showing a level shift circuit shown in FIG. 2.

FIG. 4 is a circuit diagram showing the level shift circuit 12. The level shift circuit 12 comprises PMOS transistors P1 to P4, NMOS transistors N1 and N2, and inverters INV1 to INV3. The digital pixel data D1 from the digital controller 11 are applied to the input terminal of the inverter INV1.

For example, when a high level signal is applied to the input terminal of the inverter INV1, an output from the inverter INV1 is a low level, and an output from the inverter INV2 is a high level. Therefore, the PMOS transistors P1 and P3 and the NMOS transistor N2 are turned on, and the PMOS transistors P2 and P4 and the NMOS transistor N1 are turned off. Thus, the input terminal of the inverter INV3 is equal to the ground voltage. The inverter INV3 is driven by the power source voltages VDD1 and VDD2. Therefore, when the input terminal of the inverter INV3 is equal to the ground voltage, the output voltage of the inverter INV3 is approximately equal to the power source voltage VDD2.

On the contrary, when a low level signal is applied to the input terminal of the inverter INV1, the output from the inverter INV1 is a high level, and the output from the inverter INV2 is a low level. Therefore, the PMOS transistors P2 and P4 and the NMOS transistor N1 are turned on, and the PMOS transistors P1 and P3 and the NMOS transistor N2 are turned off. Thus, the input terminal of the inverter INV3 has a voltage approximately equal to the power source voltage VDD2, and the output terminal has a voltage approximately equal to the power source voltage VDD1.

Figure 5:
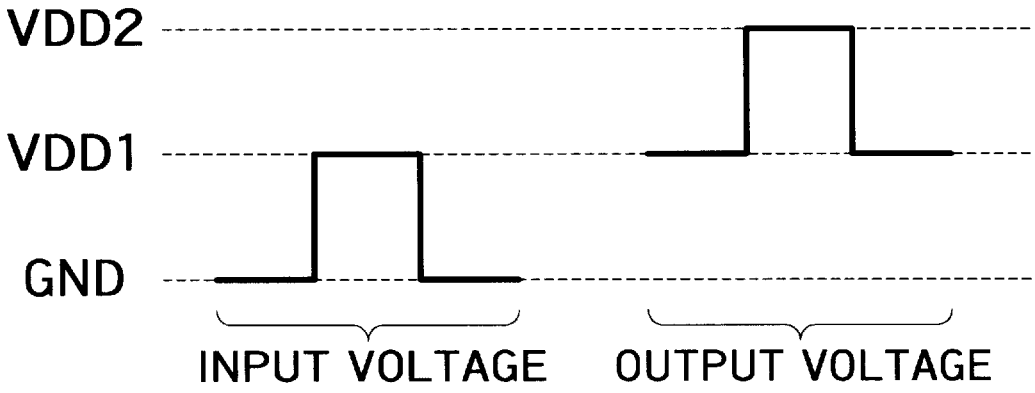
FIG. 5 is a graph illustrating wave shapes of input and output voltages of the level shift circuit of FIG. 4.

The level shift circuit 12 performs a level changing operation for the digital pixel data D1 in order that the digital pixel data D1 is converted to the digital pixel data D3, as shown in FIG. 5.

FIG. 5 is a graph illustrating wave shapes of input and output voltages of the level shift circuit 12. Specifically, the high level of the digital pixel data D1 is equal to the power source voltage VDD1 and the low level thereof is equal to the ground voltage, and the high level of the digital pixel data D3 is equal to the power source voltage VDD2 and the low level thereof is equal to the power source voltage VDD1. The liquid crystal display device illustrated in FIG. 2 comprises the level shift circuit 12 having the configuration of FIG. 4 for each bit of the digital pixel data.

Referring again to FIG. 2, the D/A converter 13 converts the digital pixel data D3 to the positive side analog voltage signal A1, and outputs it. Similarly, the D/A converter 14 converts the digital pixel data D2 to the negative side analog voltage signal A2, and outputs it.

The liquid crystal panel 15 includes a plurality of switches. For clarity, only switches SW2 and SW3 are labeled. A source electrode line S2 for each pixel is coupled to one terminal of both switches SW2 and SW3. The other terminal of the switch SW2 is coupled to the output terminal of the D/A converter 13, and the other terminal of the switch SW3 is coupled to the output terminal of the D/A converter 14.

One of the switches SW2 and SW3 corresponding to each pixel is turned on. The switches SW2 and SW3 for the adjacent pixel are conversely turned on/off. Specifically, when the switch SW2 corresponding to a certain pixel is turned on, the switch SW3 corresponding to the other pixel adjacent to that pixel is turned on.

As described above, the switches SW2 and SW3, which correspond respectively to the adjacent pixels, are conversely turned on/off, so that one of the pixels adjacent to each other is supplied with the positive side analog voltage signal A1, and the other is supplied with the negative side analog voltage signal A2, as shown in FIG. 1.

The inversion driving type liquid crystal display device shown in FIG. 2 generates the positive side analog voltage signal A1 and the negative side analog voltage signal A2 from the digital pixel data. Formerly, the positive side analog voltage signal A1 is generated by the level shift circuit shown in FIG. 4.

As described above, the digital pixel data are outputted from about twenty signal lines. The level shift circuit 12 of the structure shown in FIG. 4 is coupled to each of these signal lines in order to conduct the level changing operation. Therefore, several problems may arise.

First, when the digital pixel data are supplied to the D/A converter 13 via the level shift circuit 12, a signal delay may be created. Since the digital pixel data for generating the negative side analog voltage A2 is directly inputted to the D/A converter 14 without interposing the level shift circuit 12, a difference between an output timing of the D/A converter 13 and an output timing of the D/A converter 14 may be produced, such that the difference may lower the quality of the liquid crystal display image.

Secondly, the level shift circuit 12 may increase the power consumption. In the level shift circuit 12 shown in FIG. 4, the direct current flows from the power source voltage VDD2 to the ground terminal at the moment when the input signal is inverted. It is predicted that the number of bits in the D/A converters 13 and 14 increases hereafter. Corresponding to such circumstances, the number of the input signal lines of them is increased. Therefore, the number of the level shift circuits 12 has to be increased. However, the increase in the number of the level shift circuits 12 may give rise to an increase in the foregoing direct current, so that the power consumption may further increase.

Figure 6:
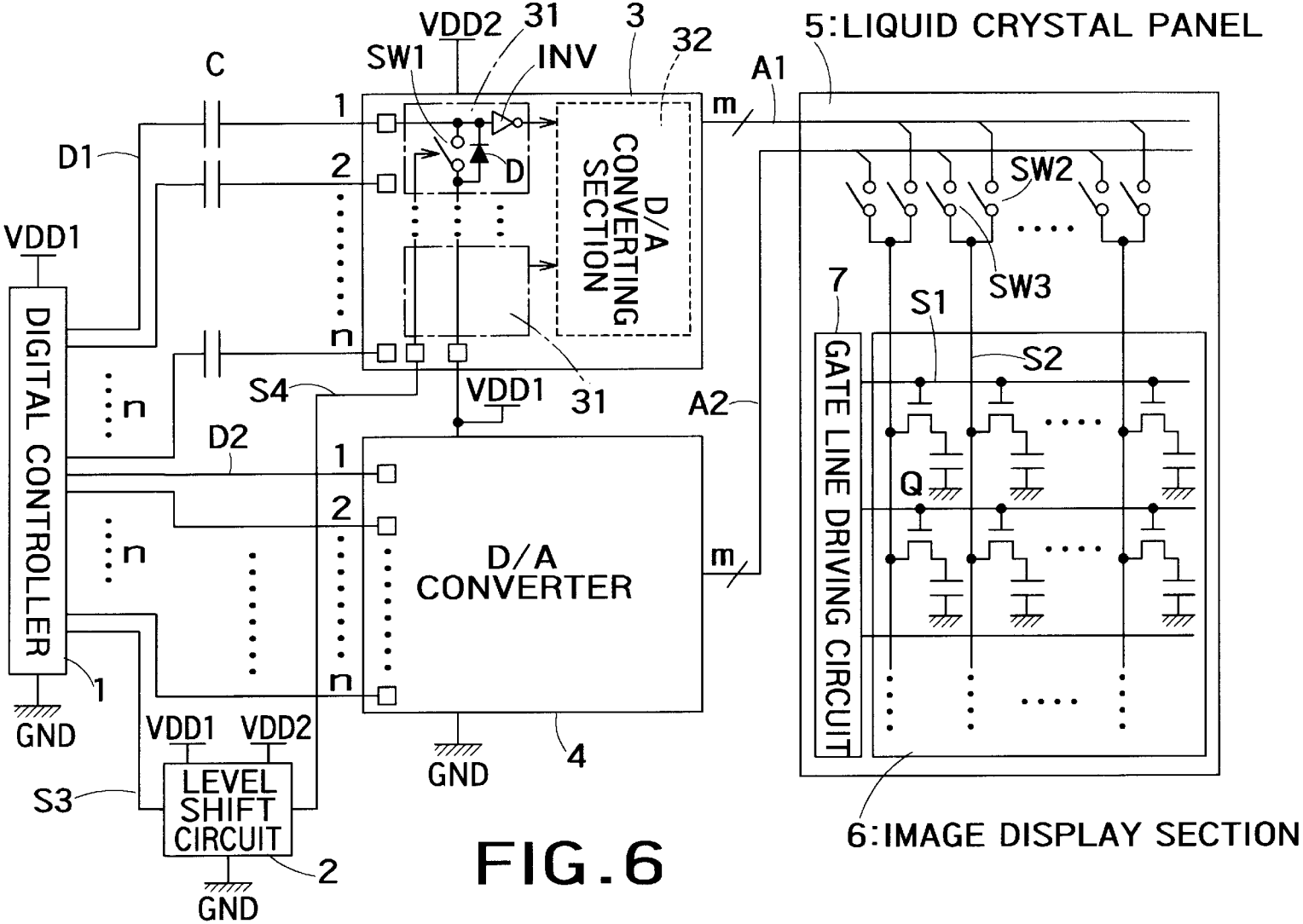
FIG. 6 is a block diagram showing a liquid crystal display device according to an embodiment of the present invention.

FIG. 6 is a block diagram of a liquid crystal display device according to an embodiment of the present invention. The liquid crystal display device comprises a digital controller 1, a level shift circuit 2, a plurality of capacitors C, digital-to-analog (D/A) converters 3 and 4, and a liquid crystal panel 5, which performs a liquid crystal displaying according to the foregoing dot inversion type.

The digital controller 1 converts image data outputted from a central processing unit (CPU) (not shown) or the like to digital pixel data D1 and D2 for the liquid crystal displaying, and outputs it. The digital pixel data D1 is inputted to the D/A converter 3 via the plurality of capacitors C, and the digital pixel data D2 is inputted to the D/A converter 4. The digital pixel data D1 and D2 comprise a plurality of bits (n bits) including a RGB signal, a clock signal and control signals, respectively. The control signals are, for example, a horizontal/vertical synchronous signals and the like.

While each bit signal of the digital pixel data D1 is inputted to the D/A converter 3 via a respective one of the plurality of capacitors C, the digital pixel data D2 is directly inputted to the D/A converter 4. The D/A converter 3 is driven by the power source voltages VDD1 and VDD2 as a drive power source and generates a positive side analog voltage signal A1 in accordance with the digital pixel data D1. On the other hand, the D/A converter 4 is driven by the ground voltage and the power source voltage VDD1 as another drive power sources and generates a negative side analog voltage signal A2 in accordance with the digital pixel data D2.

In another embodiment of the present invention, the D/A converter 3 may be driven by a third power source voltage that differs from the power source voltage VDD1.

In one embodiment of the present invention, the voltage difference between the power source voltage VDD1 and the ground voltage is set equal to the voltage difference between the power source voltages VDD1 and VDD2. For example, the power source voltage VDD1 is set to 5V, and the power source voltage VDD2 is set to 10V.

The D/A converter 3 includes a plurality of charging control circuits 31 and a D/A converting section. Each of the control circuits 31 is arranged to correspond with one of the capacitors C. Each of the charging control circuits 31 comprises a switch SW1 and a diode D which are coupled in parallel, and an inverter INV. The switch SW1 is controlled to be turned on or off in response to a switching signal inputted thereto from the digital controller 1 via the level shift circuit 2. One terminal of the switch SW1 and the cathode terminal of the diode D are coupled to one terminal of the capacitor C and the input terminal of the inverter INV. The other terminal of the switch SW1 and the anode terminal of the diode D are set to the power source voltage VDD1. In one embodiment of the present invention, the D/A converting section 32 comprises a plurality of digital-to-analog converters, each of which is coupled to a corresponding charging control circuit 31.

The liquid crystal panel 5 includes an image display section 6 and a gate line driving circuit 7. The image display section 6 and the gate line driving circuit 7 may be conventional and are well known to one skilled in the art. In the image display section 6, a plurality of gate lines S1 and a plurality of source electrode lines S2 are arranged horizontally and vertically, respectively. The polysilicon type TFT Q, for example, is coupled to each intersection of the gate lines S1 and the source electrode lines S2. The switches SW2 and SW3 are coupled to one terminal of each of the source electrode lines S2. The other terminal of the switch SW2 is supplied with the positive side analog voltage signal A1 outputted from the D/A converter 3, and the other terminal of the switch SW3 is supplied with the negative side analog voltage signal A2 outputted from the D/A converter 4.

Figure 7:
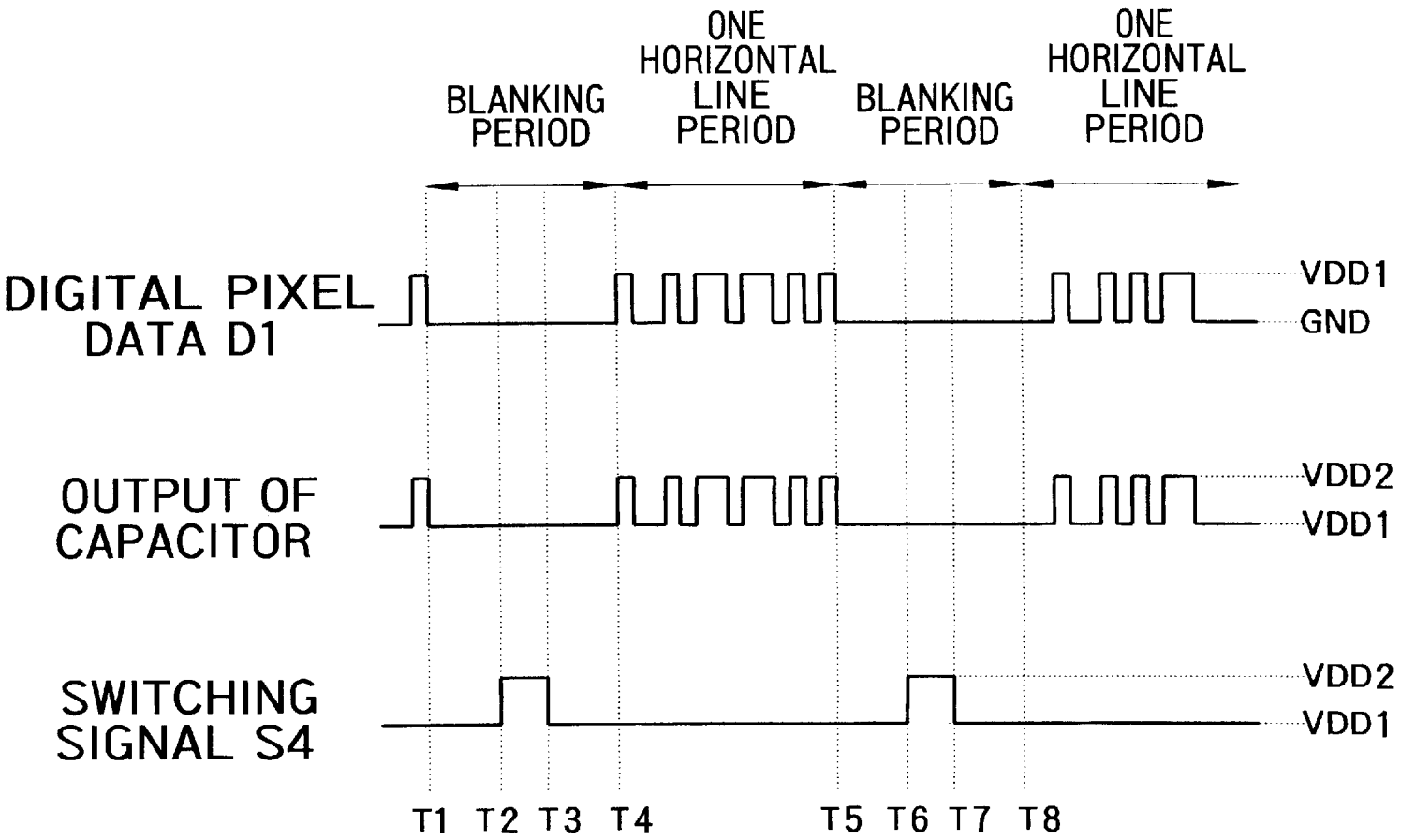
FIG. 7 is a timing chart showing an operation of the liquid crystal display device of FIG. 6.

FIG. 7 shows a timing chart illustrating an operation of the liquid crystal display device of FIG. 6. The times T4 and T5 illustrated in the timing chart of FIG. 7 show the time period of the operation timing of one horizontal line of the liquid crystal panel 5. The times T1 to T4 and T5 to T8 show the blanking periods between the horizontal lines.

The digital pixel data D2 outputted from the digital controller 1 is inputted to the D/A converter 4 and converted to the negative side analog voltage signal A2. On the other hand, the digital pixel data D1 undergoes the level change by the capacitors C, and, thereafter, is inputted to the D/A converter 3 for conversion to the positive side analog voltage signal A1.

The level shift circuit 2 converts the switching signal S3 outputted from the digital controller 1 to a signal S4, which has a voltage level between the power source voltages VDD1 and VDD2. The signal S4 is applied to a control terminal of the switch SW1 in each of the charging control circuits 31.

As described above, the voltage levels of the digital pixel data D1 and the switching signal S3 are changed. This is because while the digital controller 1 uses the ground voltage and the power source voltage VDD1 as the driving power source, the D/A converter 3 uses the power source voltages VDD1 and VDD2 as the driving power source.

As shown in FIG. 7, the digital controller 1 sets the switching signal S3 and thereby S4 at a high level for a predetermined period of time within each blanking period after displaying one horizontal line. At the same time, the digital controller 1 sets all bits of the digital pixel data D1 at a low level (ground voltage) (time T2 to T3, and T6 to T7).

When the switching signal S4 becomes a high level, the switch SW1 is turned on, so that the voltage of the coupled path of the capacitor C and the switch SW1 is set to the power source voltage VDD1. At this time, a level at one terminal of each capacitor C is set to a low level by the digital controller 1, and the power source voltage VDD1 is applied to the other terminal of each capacitor C. Thus, each of the capacitors C is charged.

Although a charging time of the capacitor C is not particularly limited, the capacitor C preferably is fully charged during one charging operation. For example, if the blanking period is set to about 5 (s, the charging may be performed for about 2 (s within the blanking period.

When the blanking period is completed, the digital pixel data D1 is outputted from the digital controller 1. The digital pixel data D1 is a signal voltage having two voltage levels, one being the ground voltage at a low level and the other being the power source voltage VDD1 at a high level. This voltage is applied to one terminal of the capacitor C.

At the time when the blanking period is completed, the capacitor C is approximately in a fully charged state, and the voltage across both terminals of the capacitor C is approximately equal to the power source voltage VDD1. Therefore, when the digital pixel data D1 is applied to one terminal of the capacitor C, the other terminal of the capacitor C is subjected to a level shift to a signal voltage according to a charge conservation law, the signal voltage having two voltage levels, one of which is the power source voltage VDD1 at a low level, and the other of which is the power source voltage VDD2 (VDD1+VDD1) at a high level.

Moreover, the diode D is coupled to the common node of the capacitor C and the inverter INV so that the diode D is inversely biased, and the anode terminal of the diode D is fixedly set to the power source voltage VDD1. Hence, the minimum voltage level of this common node is approximately equal to the power source voltage VDD1.

As described above, the coupling of the cathode terminal of the diode D to the coupled path of the capacitor C and the inverter INV holds a voltage applied to the inverter INV to be less than the power source voltage VDD1, so that the diode D also functions as an input protection diode.

The digital pixel data passing through the charging control circuit 31 is converted to the positive side analog voltage signal A1 and outputted from the D/A converter 3. The analog voltage signals A1 and A2 outputted from the respective two D/A converters 3 and 4 are inputted to the respective switches SW2 and SW3 in the liquid crystal panel 5. These switches SW2 and SW3 are provided for each pixel. Each of the switches SW2 and SW3 corresponding to a pixel is controlled to be conversely turned on or off. The switch corresponding to a certain pixel is turned on or off conversely to the switch corresponding to the adjacent pixel. Thus, similar to the device of FIG. 2, the positive side analog voltage signal A1 and the negative side analog voltage signal A2 are alternately supplied to the source electrode line S2 in the liquid crystal panel 5.

As described above, the dot inversion type liquid crystal display device of this embodiment of the present invention is constituted such that each of the capacitors C is coupled to the corresponding bit of the digital pixel data D1 supplied from the digital controller 1, and the voltage level of the digital pixel data D1 is converted by periodically charging the capacitor C. Hence, unlike the device shown in FIG. 2, it is unnecessary to couple the level shift circuit with each bit, leading to a great reduction in the power consumption of the liquid crystal display device.

In the embodiment of FIG. 2, the digital pixel data D1 is transmitted through the level shift circuit 12, and applied to the D/A converter 13, which may cause a signal delay. In the liquid crystal display device of the embodiment of the present invention shown in FIG. 6, since the digital pixel data D1 is inputted through the capacitor C to the D/A converter 3, the signal delay is minimal. Consequently, the difference between the outputting times of the positive and negative side analog voltage signals A1 and A2 supplied to the liquid crystal panel 5 is minimal, thus increasing the image quality of the liquid crystal display screen.

In the charging control circuit 31 of FIG. 6, the diode D which has been heretofore used for the input protection is used also for charging the capacitor C, and only the switch SW1 and the capacitor C are newly needed. Therefore, the circuit constitution can be greatly simplified, compared to the case where the level shift circuit in the liquid crystal display device of FIG. 2 or the like is provided.

In the charging control circuit 31 shown in FIG. 6, while the switch SW1 and the diode D are coupled in parallel, either of them may be omitted. When, for example, the switch SW1 is omitted and only the diode D is left, the voltage at the coupled path of the capacitor C and the inverter INV is set to approximately the power source voltage VDD1. By making all of the bits of the digital pixel data D1 low in level during the blanking period, all of the capacitors C can be charged. Furthermore, in this case, it is unnecessary to output the switching signal S3 from the digital controller 1.

On the contrary, when the diode D is omitted and only the switch SW1 is left, the capacitor C can be charged by turning on/off the switch SW1, and an operation similar to the circuit of FIG. 6 is performed. In this case, the diodes D can be omitted by the number equal to that of the capacitors C, whereby the circuit constitution of the liquid crystal display device can be simplified.

In the above described embodiment of the present invention, although the capacitor C is charged during the blanking period after displaying one horizontal line, the charging of the capacitor C may be performed during another blanking period after displaying one screen (one frame). Moreover, the charging of the capacitor C may be also performed during both of the blanking periods after displaying one horizontal line and displaying one screen.

In the above described embodiment of the present invention, the dot-inversion type liquid crystal display device which inverts the voltage applied to the TFT for each pixel has been described. The present invention can be applicable also to the case where the voltage is inverted for each horizontal line or the voltage is inverted for each screen (frame). Alternatively, the voltage may be inverted for each group of a plurality of groups comprising plural pixels.

The liquid crystal display device of FIG. 6 performs the level conversion of the digital pixel data D1 using the capacitor C, and in another embodiment of the present invention, a MOS transistor and the like may be used instead of the capacitor C for performing an equivalent function to that of the capacitor C.

Moreover, although in FIG. 6, the charging control circuit 31 is provided within the D/A converter, in another embodiment of the present invention, the charging control circuit 31 and the D/A converter may be separated and provided in different chips.

As shown in FIG. 6, because the D/A converter 4 is not coupled to the capacitor C, the D/A converter 4 does not need a charging control circuit 31. However, in another embodiment of the present invention, the configuration of the D/A converter 4 may be the same as that of the D/A converter 3.

Figure 8:
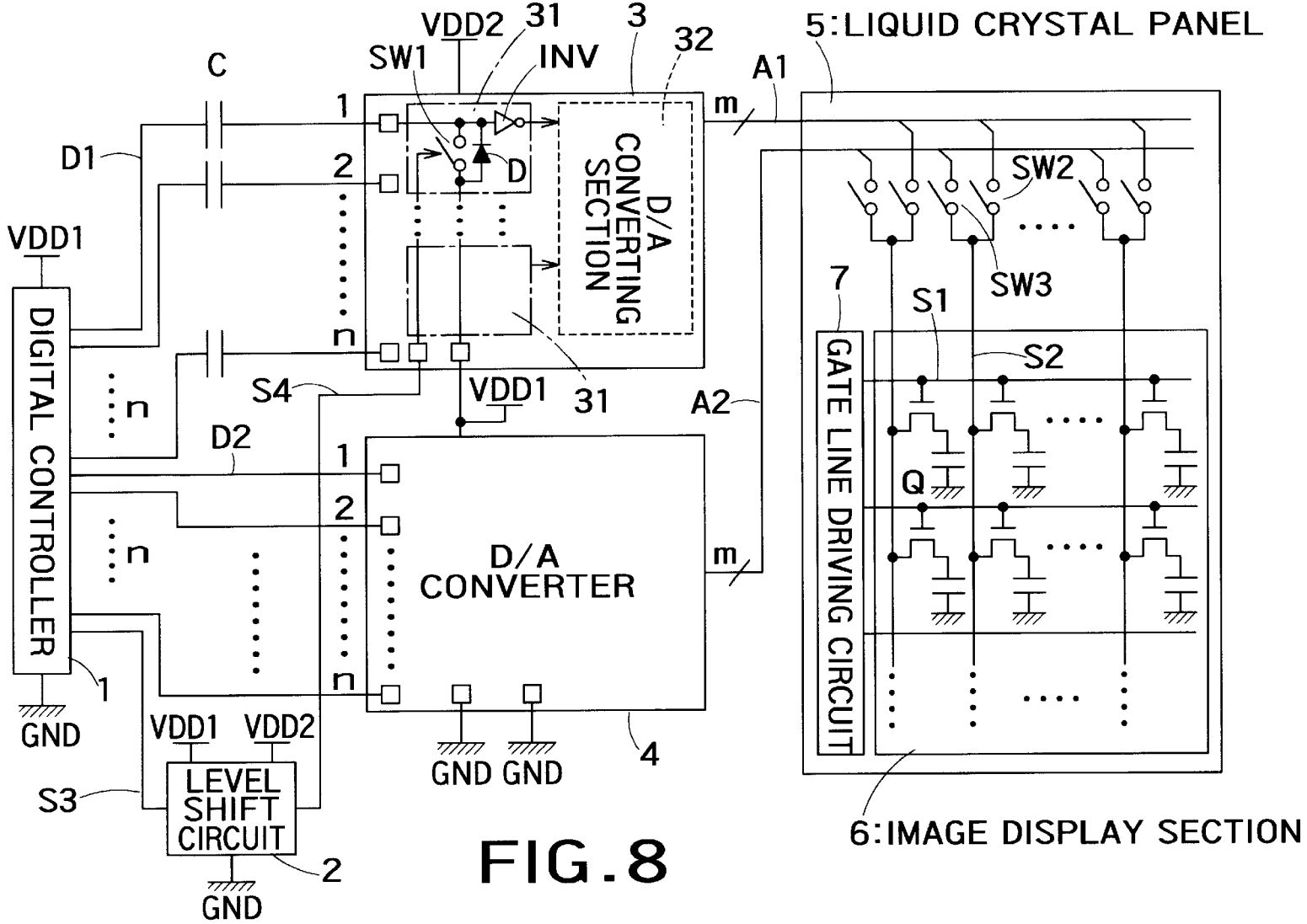
FIG. 8 is a block diagram showing a liquid crystal display device in which the configuration of the D/A converter 4 is the same as that of the D/A converter 3.

FIG. 8 is a block diagram showing a liquid crystal display device in which the configuration of the D/A converter 4 is the same as that of the D/A converter 3. As shown in FIG. 8, it is desirable to connect the control terminal of the switch SW1 in the D/A converter 4 to the ground terminal, so that the switch SW1 is always turned off.

Thus, when the D/A converters 3 and 4 have the same configuration, it is possible to decrease the number of different types of parts in the liquid crystal display device; consequently, the production process of the liquid crystal display device is simplified.

Obviously, numerous modifications and variations of the present invention are possible in light of the above teachings. It is therefore to be understood that within the scope of the appended claims, the invention may be practiced otherwise than as specifically described herein.

What is claimed is:

1. A device for controlling a liquid crystal display device comprising:

a digital control circuit for receiving a first voltage and a second voltage higher than the first voltage as reference voltages and having a plurality of outputs, each output providing a plurality of bits of digital image data in parallel and in response to said reference voltages;

a plurality of capacitors, each capacitor having a first terminal coupled to the corresponding one of said plurality of outputs of said digital control circuit for receiving said plurality of digital image data and having a second terminal;

a plurality of charging controllers, each charging controller having an input terminal coupled to the second terminal of a corresponding one of said capacitors and having an output terminal; and a digital-to-analog (D/A) converter coupled to the output terminal of each said charging controller, said D/A converter receiving a fourth voltage and a fifth voltage higher than the fourth voltage as reference voltages and outputting an analog voltage to an external liquid crystal panel, wherein after data is outputted from said charging controller, each second terminal of said capacitors is charged to a third voltage, charging is stopped in order to set each of the second terminals of said capacitors to a floating state, and said digital image data are outputted from the digital control circuit.

2. A device for controlling a liquid crystal display device comprising:

a digital controller for receiving a first voltage and a second voltage higher than the first voltage as reference voltages and outputs first and second digital pixel data;

a plurality of capacitors, each capacitor having a first terminal coupled to the digital controller for receiving the first digital pixel data and having a second terminal;

a plurality of charging controllers, each charging controller having an input terminal coupled to the second terminal of a corresponding one of said capacitors;

a first digital-to-analog (D/A) converter coupled to each output terminal of said charging controller, the first D/A converter receiving a fourth voltage and a fifth voltage higher than the fourth voltage as reference voltages and outputting a first analog voltage signal;

a second D/A converter for receiving said second digital pixel data outputted from the digital control circuit, the second D/A converter receiving a sixth voltage and a seventh voltage higher than the sixth voltage and outputting a second analog voltage signal; and a first switch for alternately switching between the first and second analog voltage signals in order to selectively apply either the first or second analog voltage signal to a liquid crystal panel at a predetermined timing, wherein after data is outputted from said charging controller, each second terminal of said capacitors is charged to a third voltage, charging is stopped in order to set each second terminal of said capacitors to a floating state, and said first digital pixel data is outputted from said digital controller.

3. The device for controlling a liquid crystal display device according to claim 2, wherein after either said first digital pixel data or said second digital pixel data is outputted, either data obtained by adding said second voltage to said third voltage or data obtained by adding said first voltage to said third voltage is outputted from said charging controller via said capacitors.

4. The device for controlling a liquid crystal display device according to claim 2, wherein the charging of the capacitors is performed in a blanking period from the completion of a displaying period of one horizontal line until the beginning of a displaying period of the next horizontal line.

5. The device for controlling a liquid crystal display device according to claim 2, wherein said charging controller comprises a second switch having one terminal coupled to said capacitors and having another terminal set to said third voltage.

6. The device for controlling a liquid crystal display device according to claim 5, wherein said second switch is turned on or off by a switching signal outputted from said digital controller.

7. The device for controlling a liquid crystal display device according to claim 2, wherein each of said charging controllers comprises a diode having a cathode terminal coupled to the corresponding second terminal of said capacitors and an anode terminal set to said third voltage.

8. The device for controlling a liquid crystal display device according to claim 2, wherein a potential difference between said first and second voltages is equal to a potential difference between said fourth and fifth voltages.

9. The device for controlling a liquid crystal display device according to claim 2, wherein a potential difference between said fourth and fifth voltages is equal to a potential difference between said sixth and seventh voltages.

10. The device for controlling a liquid crystal display device according to claim 2, wherein said third voltage is equal to said fourth voltage.

11. The device for controlling a liquid crystal display device according to claim 2, wherein said second voltage is equal to said fourth voltage.

12. The device for controlling a liquid crystal display device according to claim 2, wherein said charging controller and said first D/A converter are formed in the same chip.

13. A liquid crystal display device, comprising:

a digital controller which receives a first voltage and a second voltage higher than said first voltage as reference voltages and outputs a plurality of digital pixel data;

a plurality of capacitors, each one terminal of which is coupled to a corresponding one of said digital pixel data;

a charging controller, each input terminal of which is coupled to another terminal of a corresponding one of said capacitors; and a digital-to-analog (D/A) converter coupled to each output terminal of said charging controller, said D/A converter receiving a fourth voltage and a fifth voltage higher than the fourth voltage as reference voltages and outputting an analog voltage signal to a liquid crystal panel, said liquid crystal panel comprising a plurality of switching elements and applying said analog voltage signal to each of said plurality of switching elements, each switching element being arranged in correspondence with each of a plurality of pixels, wherein after data is outputted from said charging controller, each said another terminal of said capacitors is charged to a third voltage, charging is stopped in order to set each said another terminal of said capacitors to a floating state, and said digital pixel data is outputted from said digital controller.

14. A liquid crystal display device, comprising:

a digital control circuit which receives a first voltage and a second voltage higher than the first voltage as reference voltages and outputs first and second digital pixel data;

a plurality of capacitors, one terminal of each capacitor being coupled to receive said first digital pixel data;

a charging control circuit, each input terminal thereof being coupled to another terminal of corresponding one of said capacitors;

a first digital-to-analog (D/A) converter coupled to each output terminal of said charging control circuit, said first D/A converter receiving a fourth voltage and a fifth voltage higher than said fourth voltage as reference voltages and outputting a first analog voltage signal;

a second D/A converter which receives a sixth voltage and a seventh voltage higher than said sixth voltage as reference voltages, and performing an analog conversion of said second digital pixel data, and outputs a second analog voltage signal;

a switch for switching between said first and second analog voltages for either every one pixel or every one horizontal line and selectively outputting either said first analog voltage signal or said second analog voltage signal; and a display panel having a plurality of switching elements and a plurality of pixels, the display panel applying either said first analog voltage signal or said second analog voltage signal to said plurality of switching elements, each switching element being arranged in correspondence with each of said plurality of pixels, wherein after data is outputted from said charging control circuit, each said another terminal of said capacitors is charged to a third voltage, charging is stopped in order to set each said another terminal of said capacitors to a floating state, and said first digital pixel data is outputted from said digital control circuit.

15. The liquid crystal display device according to claim 14, wherein said switch is formed in said display panel.

16. The liquid crystal display device according to claim 14, wherein said switch is a polysilicon type thin film transistor.

17. A digital-to-analog converting semiconductor device formed on a semiconductor substrate comprising:

a plurality of charging control circuits, each charging control circuit including a switch and a diode connected in parallel, said switch being turned on or off in response to a control signal, and said plurality of charging control circuits outputting digital signals with voltage levels regulated by turning on/off said switches;

a digital-to-analog (D/A) converter for outputting analog voltage signals in accordance with the digital signals outputted from said plurality of charging control circuits, and in response to first and second reference voltages applied to respective first and second voltage input terminals;

wherein an anode terminal of said diode is coupled to said first voltage input terminal, and a cathode terminal of said diode is coupled to an input terminal of the corresponding one of said plurality of charging control circuits.

18. A liquid crystal display device comprising:

first and second digital-to-analog (D/A) converting devices comprising a plurality of charging control circuits, each of the charging control circuits including a first switch, a diode connected in parallel to said first switch, and a D/A converter which outputs analog voltage signals in accordance with digital signals applied to input terminals of said plurality of charging control circuit, and in response to reference voltages applied to a first voltage input terminal and a second voltage input terminal thereof;

a digital control circuit for outputting a plurality of bits of digital image data in parallel, in response to reference voltages having a first voltage and a second voltage higher than the first voltage;

a plurality of capacitors, each capacitor having one terminal for application of said digital image data thereto;

a second switch for switching between first analog voltage signals outputted from said first D/A converting semiconductor device and second analog voltage signals outputted from said second D/A converting semiconductor device at either every one pixel or every one horizontal line; and a pixel arraying section comprising switching elements arranged at every pixel, either said first or second analog voltage being applied to each of said switching elements.

19. The liquid crystal display device of claim 18, wherein:

for said first D/A converting device, a fourth voltage is applied to said first voltage input terminal thereof, a fifth voltage higher than said fourth voltage is applied to said second voltage input terminal thereof, and each of said input terminals of said plurality of charging control circuits is coupled to the other terminals of the corresponding one of said capacitors;

for said second D/A converting device, a sixth voltage is applied to said first voltage input terminal thereof, a seventh voltage higher than said sixth voltage is applied to said second voltage input terminal thereof, and said plurality of digital image data are applied to the corresponding one of said input terminals of said plurality of charging control circuits.

20. The liquid crystal display device of claim 18, wherein:

said first switch of either one said first or second D/A converting semiconductor device is always turned off, and said first switch of the other is repeatedly turned on/off at a predetermined cycle.

21. A device for controlling a liquid crystal display device comprising:

a digital signal controller providing first and second digital image signal, each image signal having a first state in which the level of the image signal is in a first voltage range and having a second state in which the level of the image signal is in a second voltage range;

a signal level shifter coupled to the digital signal controller and having an output for providing a third digital image signal having a first state in which the level of the image signal is in a third voltage range and having a second state in which the level of the image signal is in a fourth range, the first and third voltage ranges being different, the second and fourth voltage ranges being different; and a first digital-to-analog converter coupled to the output of the signal level shifter for converting the third digital image signal to a first analog signal in response to a first reference voltage;

a second digital-to-analog converter coupled to the digital signal controller for converting the second digital image signal to a second analog signal, the first and second analog signals being applied to a liquid crystal panel at a predetermined timing.

22. The device of claim 21 wherein the signal level shifter includes a plurality of capacitors, and after the first and second digital-to-analog converters output the analog signals, each capacitor is charged to have a voltage drop approximately equal to the difference between the first and second voltage ranges.

23. A D/A converting semiconductor device formed on a semiconductor substrate comprising:

a plurality of charging control circuit, each of which includes switching means and a diode connected in parallel;

a D/A converter for outputting analog voltages in accordance with digital signals applied to input terminals of said plurality of charging control circuit, the analog voltages being generated on the basis of reference voltages applied to a first voltage input terminal and a second voltage input terminal; wherein:

said switching means is turned on/off in accordance with the logic of a control signal from outside;

an anode terminal of said diode is coupled to said first voltage input terminal;

a cathode terminal of said diode is coupled to an input terminal of the corresponding one of said plurality of charging control circuit.

* * * * *